US005445280A

United States Patent [19]

Rahn

[11] Patent Number: 5,445,280

[45] Date of Patent: Aug. 29, 1995

[54] MODULAR DISPLAY RACK

[76] Inventor: Carl H. Rahn, 2329 E. 10th Ave., Apartment 203, North St. Paul, Minn. 55109

[21] Appl. No.: 143,631

[22] Filed: Nov. 1, 1993

[51] Int. Cl.[6] ..... A47F 5/00

[52] U.S. Cl. ..... 211/186; 211/201; 211/162

[58] Field of Search ..... 211/94, 162, 184, 186, 211/198, 201, 194; 108/60, 61

[56] References Cited

U.S. PATENT DOCUMENTS

| | | | |
|---|---|---|---|
| 1,473,064 | 11/1923 | Vance | 211/184 |
| 3,612,288 | 10/1971 | Lesley | 211/132 |
| 4,646,658 | 3/1987 | Lee | 108/143 |
| 4,795,042 | 1/1989 | Klein et al. | 211/186 |
| 4,984,690 | 1/1991 | King et al. | 206/503 |
| 5,042,863 | 8/1991 | Fraga | 296/24.1 |
| 5,078,284 | 1/1992 | Pirkl et al. | 211/198 |
| 5,314,080 | 5/1994 | Wentworth | 211/181 |

FOREIGN PATENT DOCUMENTS

| | | | |
|---|---|---|---|
| 995692 | 6/1965 | United Kingdom | 248/224.3 |

*Primary Examiner*—Leslie A. Braun
*Assistant Examiner*—Catherine S. Collins
*Attorney, Agent, or Firm*—D. L. Tschida

[57] ABSTRACT

A modular produce display rack having a rectangular base track removeable, sidewall panels and a hinged, multisection, perforated product support track which mounts to the sidewalls. The support track sections detachably mate at hinge joints and couple to sidewall rails at mating slots. Lateral and longitudinal dividers selectively mount to the support track to segment the display surface. The base track, sidewalls and ones of the support track sections may include extension pieces. The peripheral edge of the sidewalls may be stepped or may be formed to a variety of angular alignments. A variety of rack arrangements are achievable to accommodate displays of any desired height and depth.

19 Claims, 8 Drawing Sheets

MODULAR DISPLAY RACK

BACKGROUND OF THE INVENTION

The present invention relates to retail display cases and, in particular, to a modular product support rack for a produce case. The rack can be added to a variety of types and dimensioned cases and can be configured and re-arranged to accommodate a wide variety of product displays.

Varieties of display assemblies have been developed to support numerous types of retail and grocery commodities. Such assemblies can comprise free-standing wire and shut formed assemblies or enclosed case assemblies. When used to display perishables, for example, dairy or produce items, case assemblies typically include various mechanical support equipment, such as lighting, refrigeration units, sprayers, chillers and plumbing drains. The attendant walls and support surfaces of the assembly are constructed to be tolerant to the application.

Over time, the dimensions of many of these display cases have become standardized. Consequently the product support racks, which are used to support and segment the case interiors, are constructed to fixed dimensions and configurations. These racks may be purchased from the display case manufacturer or in the after-market.

For produce grocers, fixed dimension product support racks contain inherent disadvantages. Specifically, the limited selection of support racks limits the manner and number of display permutations a grocer can construct to display its produce. They also necessitate the purchase of separate support racks for each case and for each different type of desired display arrangement. Frequently it is also necessary to purchase separate special purpose display attachments. The net result is that the grocer is subjected to higher capital equipment costs and greater numbers of racks that must be inventoried.

Some rack inserts provide a degree of adjustability, such as hinged, cantilevered arms which permit converting horizontal support surfaces to angular supports. Some provide lateral end walls or dividers and longitudinal dividers. However, a relatively limited number of adjustments and display permutations are provided by these racks.

In appreciation of the foregoing limitations of commercially available produce display racks, the subject invention provides a modularly configured, assembly, which is re-configurable within any number of varieties of standard produce cases. Some twelve different types of conventional display mountings are readily obtained with minor modification to the arrangements of the rack components. Numerous other configurations are also possible as desired.

SUMMARY OF THE INVENTION

It is accordingly a primary object of the invention to provide a modularly configured, display case insert assembly.

It is a further object of the invention to provide an assembly having an adjustable base track which contains a number of couplers that selectively support separate sidewall panels.

It is a further object of the invention to provide an assembly which includes a sectional, hinged and perforated product support track.

It is a further object of the invention to provide a product support track sections which couple to one another at mating hinge members.

It is a further object of the invention to provide support track sections which fasten to the sidewall panels.

It is a still further object of the invention to provide sidewall sections having alternative peripheral edge shapes (e.g. stepped and angular) and which edges include tabs that cooperate with notches formed into the hinged support track.

It is a further object of the invention to provide a rack assembly adaptable to a variety of end stops and longitudinal divider pieces.

It is a further object of the invention to provide a rack assembly including extendable support track sections, sidewall panels and dividers.

Various of the foregoing objects, advantages and distinctions of the invention are particularly contained in a preferred construction which includes a depth adjustable rectangular base track. Sidewall panels are mountable to the base track at coupler sockets provided about the periphery of the base. A hinged, multi-section, perforated product support track mounts to the sidewalls at mating notches.

The depth of any desired display organization can be varied, upon adjusting the length of the base track and mounting and adjusting an appropriate number of extensible sidewall panels and support track sections, which respectively attach to the base track and upper peripheral edges of the sidewall panels. Appropriate end stops and longitudinal dividers are also provided which are adjustable and interlock with the perforations of the product support surface. The pieces interlock to provide a stable support surface capable of supporting heavy weights and withstanding the artificial environment created by the case to maintain shelf life.

Still other objects, advantages and distinctions of the invention will become more apparent from the following description with respect to the appended drawings. The description should not be literally interpreted in limitation of the scope of the invention. Rather, the invention should be interpreted within the spirit and scope of the further appended claims.

DESCRIPTION OF THE PREFERRED EMBODIMENT

Figure 1:
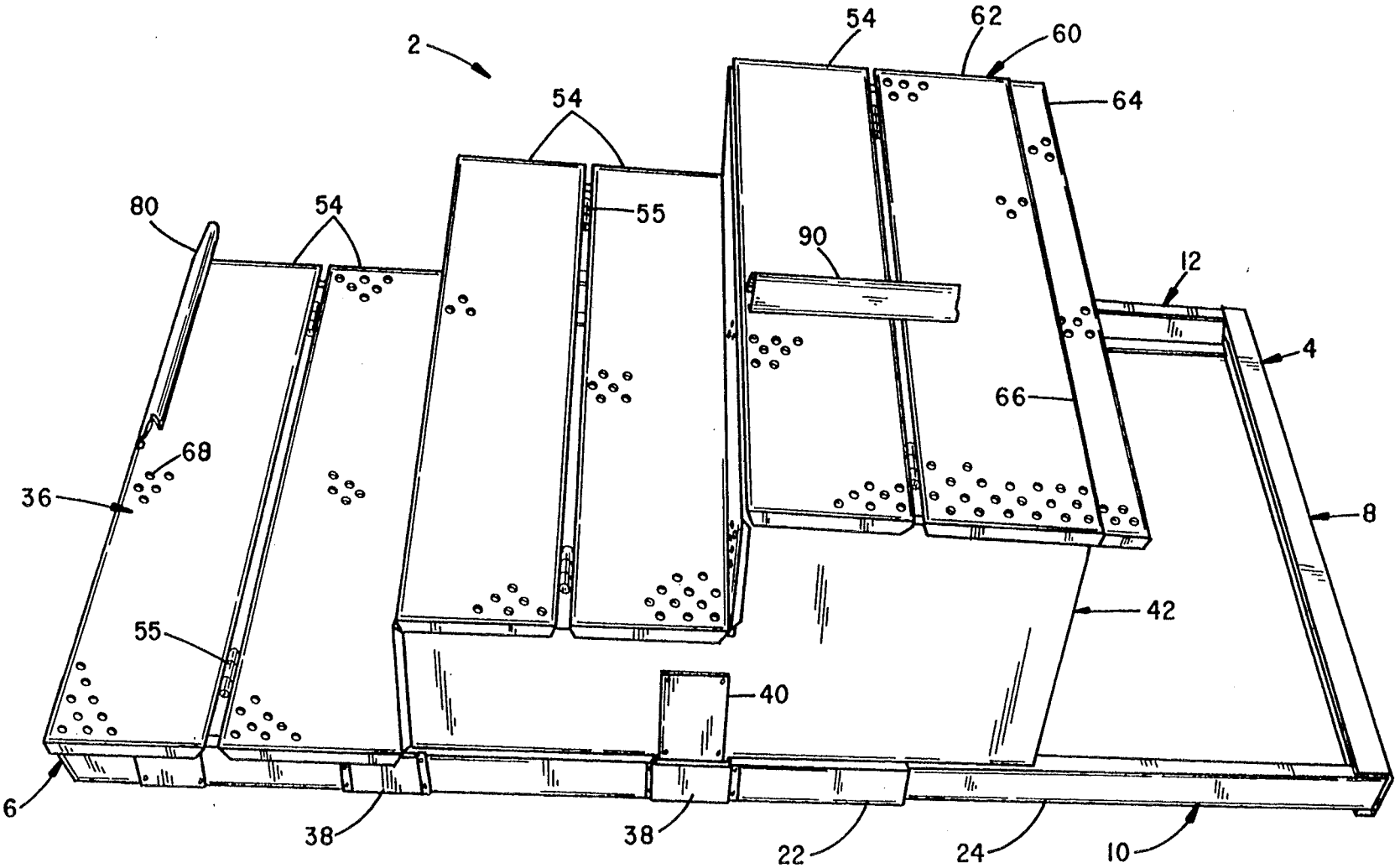
FIG. 1 is a perspective drawing of an assembled display rack insert, which can be mounted in any of a variety of commercial produce cases.

Referring to FIG. 1 a perspective drawing is shown of a typical display configuration of the modular rack 2 of the invention. The rack 2 is commonly used as an insert to aisle display stands (not shown) and display cases (not shown) which are commonly found in retail groceries. One or more racks 2 can be used to support and advantageously display a variety of items being offered for sale. The rack 2 finds particular advantage for displaying produce and other food items.

As will become more apparent, the rack 2 is adjustable and modularly constructed to support a broad variety of commodities within a broad variety of types and sizes of display stands and cases. In a presently preferred construction, the rack 2 and the sundry component parts, which in combination form the rack 2, are formed from light gauge aluminum and steel panels.

A variety of other materials may be substituted from stainless steel to painted steel to varieties of anodized aluminum to plastics. Any selected material must be capable of withstanding the loading and application. For produce products, a rack 2 must be capable of supporting 100 to 300 pounds. The rack 2 must also be tolerant of exposure to liquids, such as melting ice or water, which may be periodically sprayed onto the displayed produce.

Figure 2:
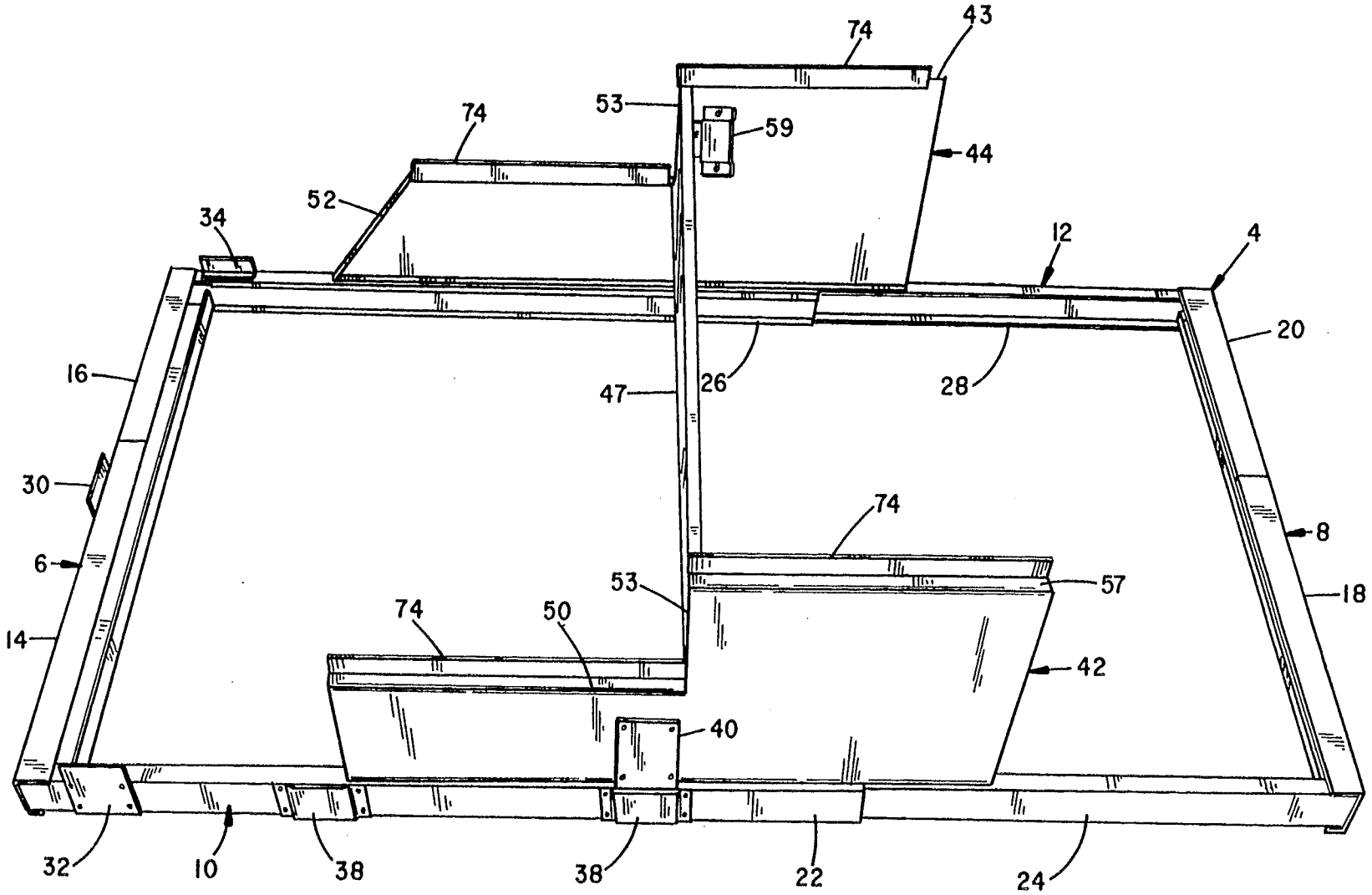
FIG. 2 is a perspective drawing shown in partial disassembly of the rack with alternative, fixed length sidewall sections.

With attention also directed to FIG. 2, the rack 2 is configured about a rectilinear base assembly 4. The base 4 is constructed from a number of interlocking channel pieces which permit the sizing of the base 4 via an extension and contraction of the base pieces to fit a display case. The base 4 particularly includes front and rear end pieces 6 and 8 and right and left side pieces 10 and 12.

The front and rear end pieces 6, 8 are depicted as being constructed of interlocking channel pieces 14, 16 and 18, 20. In the presently preferred organization the end pieces 6 and 8 are formed to a fixed width, although can be made to be adjustable as shown.

The right and left side pieces, in turn, are constructed of interlocking pieces 2 2, 24 and 26, 28. The channel pieces 14–28 each exhibit a C-shape when viewed in end profile. The base pieces 6 to 12 are secured to each other at the four corners of the base 4 with rivet fasteners. Alternatively, the base pieces 6 to 12 can be welded or a variety of other fasteners can be used to equal advantage.

Vertically projecting from the front piece 6 and right and left side pieces 10 and 12 are vertical flanges 30, 32 and 34. Rivet fasteners secure the flange pieces to the base 4. The flange 30 provides an end stop for a product support track assembly 36 which mounts over the base 4. The right and left side flanges 32, 34 support the sides of the forwardmost support track sections.

Secured along the right and left side pieces 10 and 12 and opposite to each other are a number of brackets 38. The brackets form retention pockets for vertical standoffs 40 which project from mating sidewall panels 42, 44 that are secured to the base 4. The number and mounting locations of the brackets 38 along the track pieces 10 and 12 can be varied as desired.

Alternatively configured sidewall panels 42 and 44 are shown at FIG. 2. The panels 42 and 44 are constructed to fixed lengths. The panel 42 provides a pair of step shaped peripheral support edges 50 and 57, which are formed at 90 degrees to a vertical riser 53, and which support the track 36. The panel 44 provides a forward peripheral edge 52 which rises at a predetermined angular relation to the base 4. The degree of the rise can be varied, although typically an angle in the range of 45 to 75 degrees is preferred.

Figure 5:
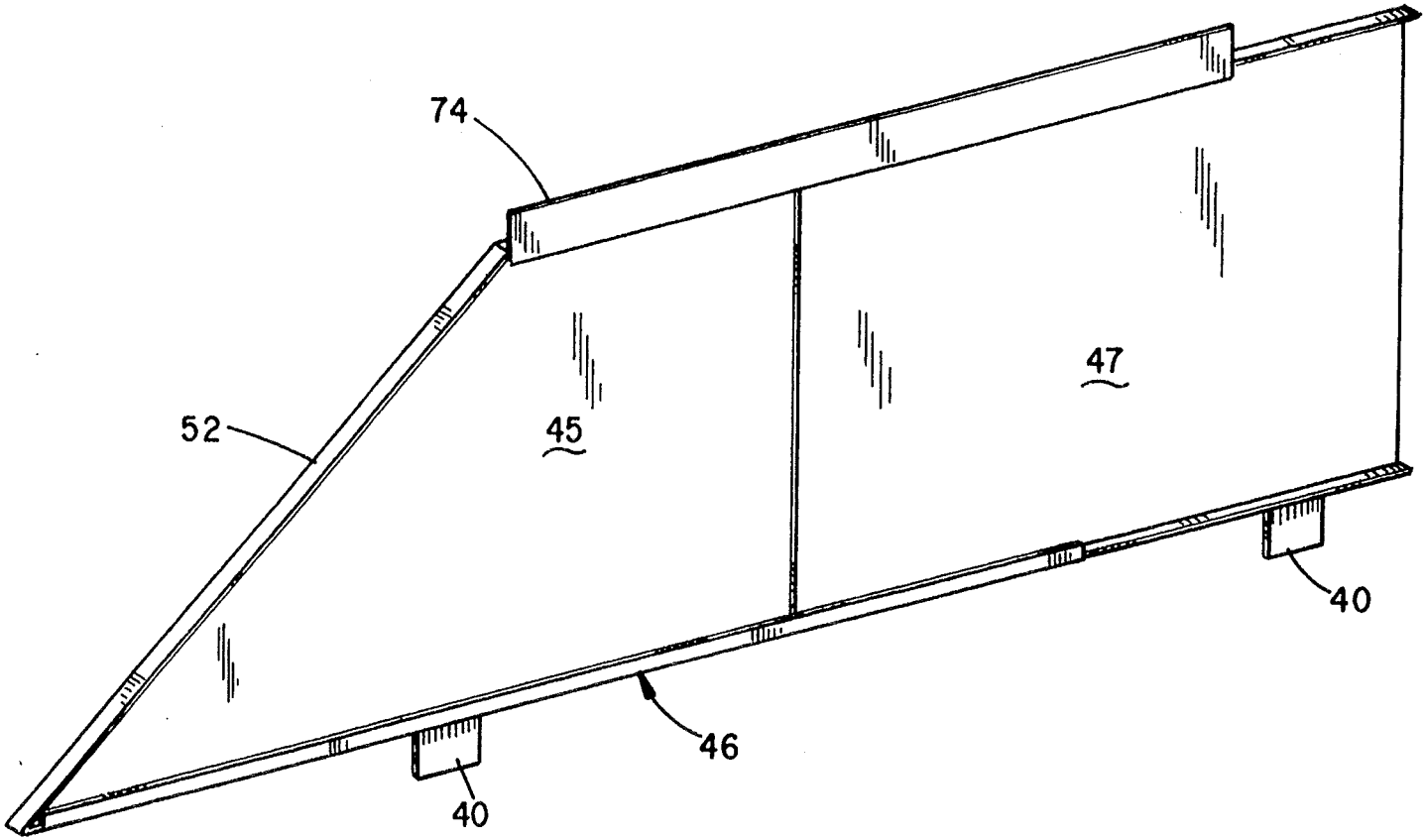
FIG. 5 is a perspective drawing of an extensible, ramped sidewall label.
Figure 6:
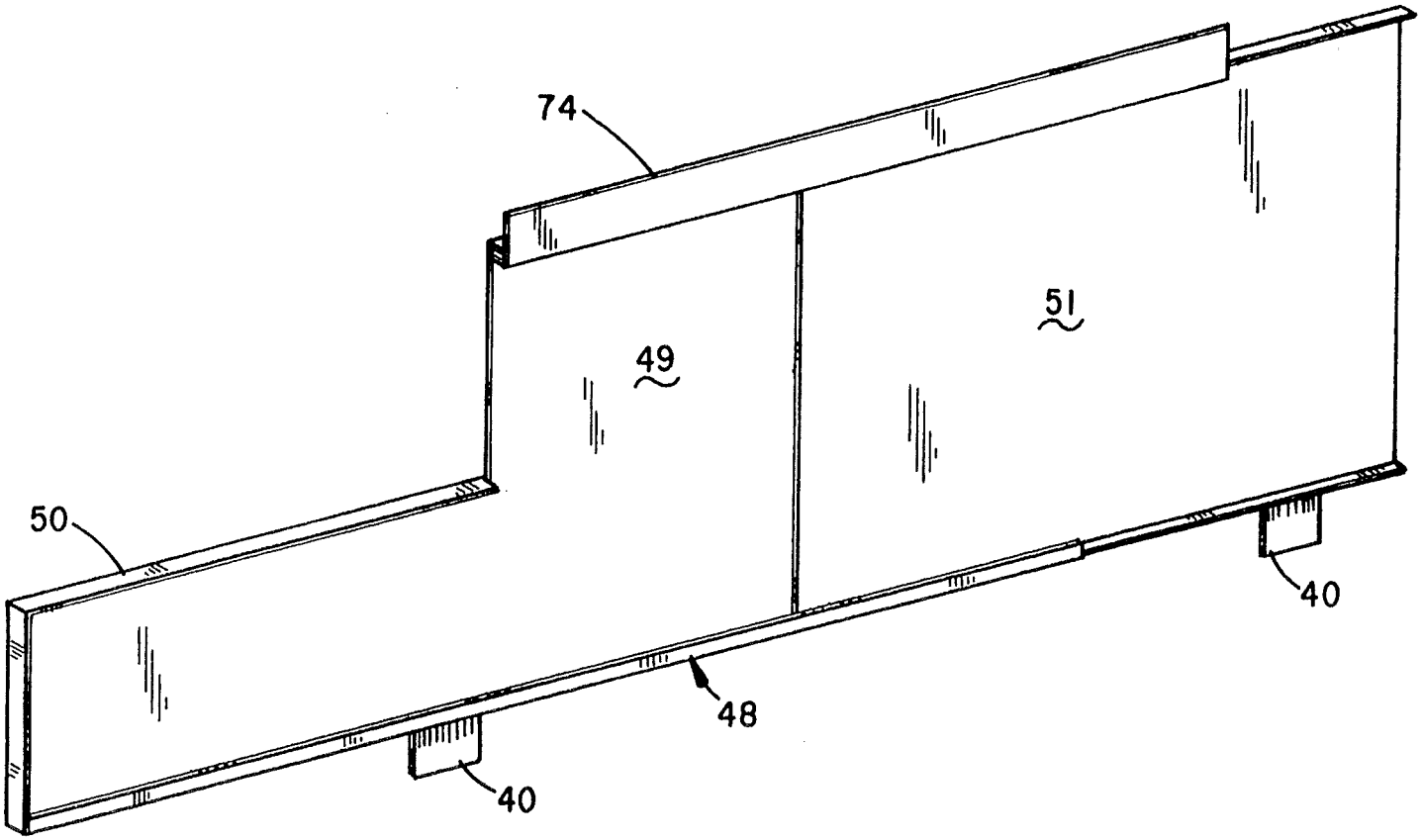
FIG. 6 is a perspective drawing of an extensible, stepped sidewall panel.
Figure 7:
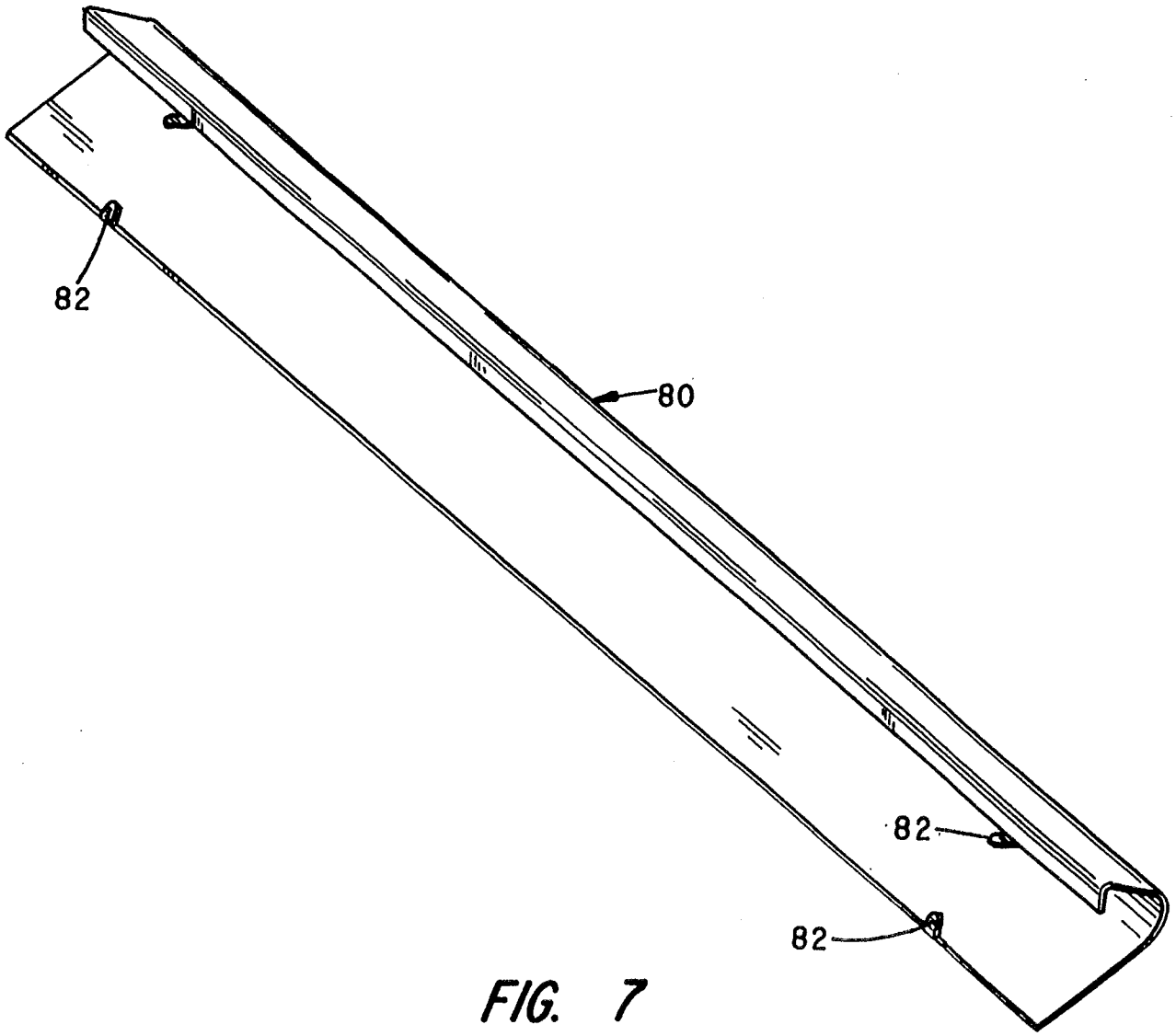
FIG. 7 is a perspective drawing of an end stop or lateral divider which mounts to the product support track.

FIGS. 5 and 6 depict alternative sidewall panels 46 and 48 which are extensible. Where the sidewall panels 42 and 44 provide fixed dimension edges for the support track 36, the sections 46 and 48 are extendible to fit a non-standard display case or stand or a particular display organization.

A cross panel 47 can be fitted to pockets 59 at pairs of sidewall panels 42–46 to laterally stabilize the rack 2. The number and dimensions of the cross panels 47 can be varied as necessary.

The relative position and numbers of sidewall panels can also be varied along the base pieces 10 and 12, depending upon the numbers and available locations of the brackets 38. The ramped sidewall panels 44, 46 typically mount to the forwardmost brackets 38. The stepped sidewalls 42, 48 are typically set rearward along the base 4, such that three horizontal support surfaces of differing heights are obtained.

Depending upon the display, the numbers, geometries and sizes of the sidewall panels 42–48 can be varied. For example, panels with more than two horizontal support edges may be provided or angular risers may be provided between each horizontal edge. The depicted constructions, however, accommodate most display arrangements.

Draped or mounted over the sidewall panels 42 of FIG. 1 is the multi-section support track assembly 36. Each section 54 of the track assembly 36 is secured to an adjacent section 54 at overlapping hinge assemblies 55 which include interconnecting pieces.

Figure 3:
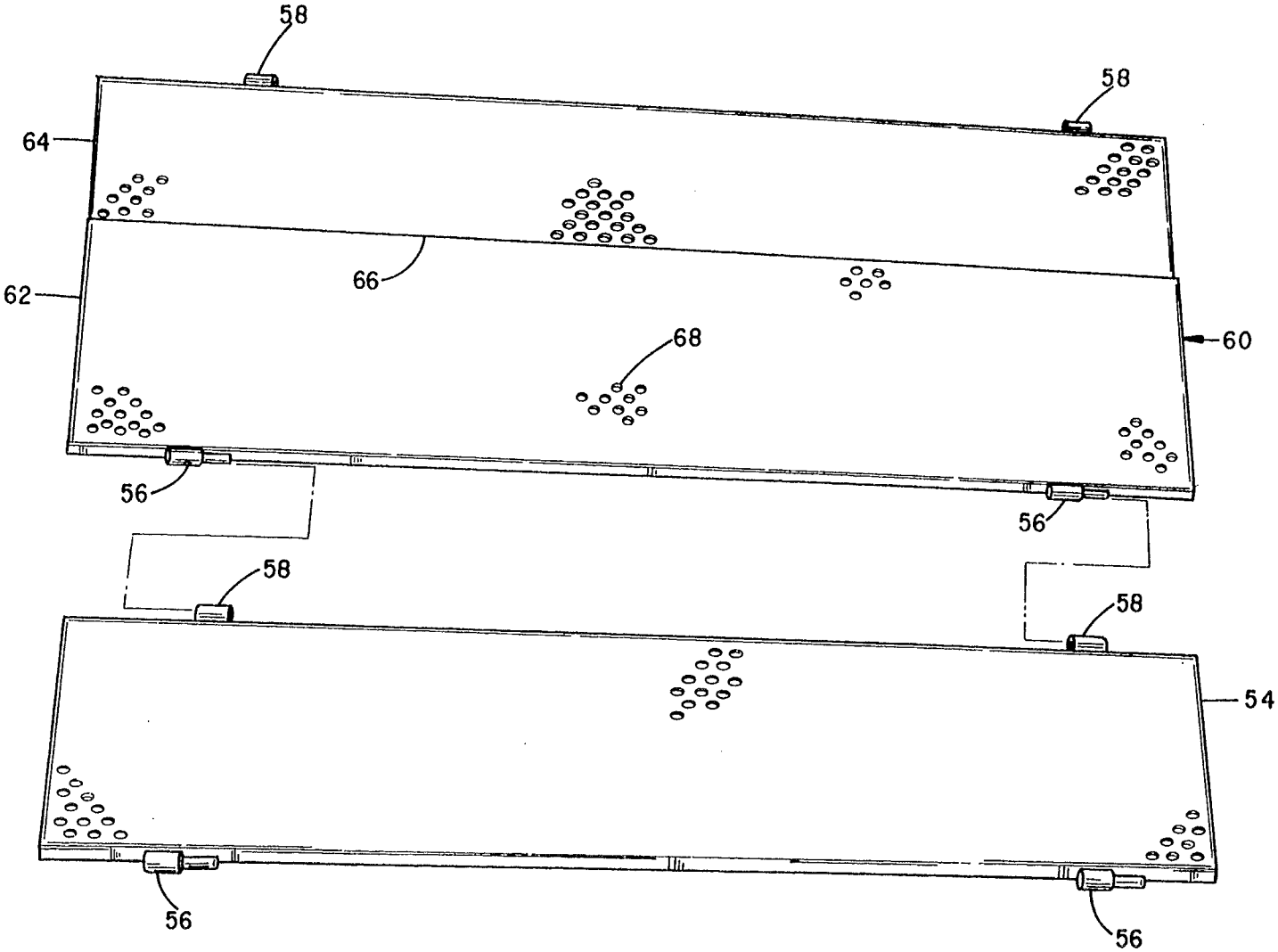
FIG. 3 is a perspective drawing shown in exploded view of a fixed dimension and adjustable product support track sections

That is and with additional attention to FIG. 3, hinge pin pieces 56 are secured along one track edge. Mating bored sleeves 58 are secured along the opposite edge of each product support track section 54. Upon aligning and coupling the hinge assemblies 55 to one another, a suitable length of product support surface is obtained. The specific length and organization of product support track 36 is tailored to the configuration of the sidewall panels.

The width of each track section 54 is sized to conform with the width of the base 4. The depth of each track section 54 is sized to conform with the depth of the horizontal edges 50, 51 and 43 of the sidewall panels 42 and 44. To accommodate the extensible horizontal edges of the sidewall panels 46 and 48 and conform the support track 36 to a case fitted therewith, one or more extensible track support sections 60 may be added to the track assembly 36.

Each track section 60 is constructed of two interlocking pieces 62 and 64 which slip fit into each other at an edge 66. Hinge pieces 56 and 58 are appropriately provided along front and rear exposed edges. In a similar fashion, it is to be appreciated a track section could be constructed which is adjustable laterally, such as the end pieces 6 and 8, although which construction is not shown.

Each track section 54 and 60 is constructed from a perforated or stamped metal to provide a number of apertures 68 through the material. The number and spacing of the apertures 68 can be varied as desired. The apertures permit air circulation about the supported product. Liquids are also able to drain into the display case, which typically includes a waste drain.

Figure 4:
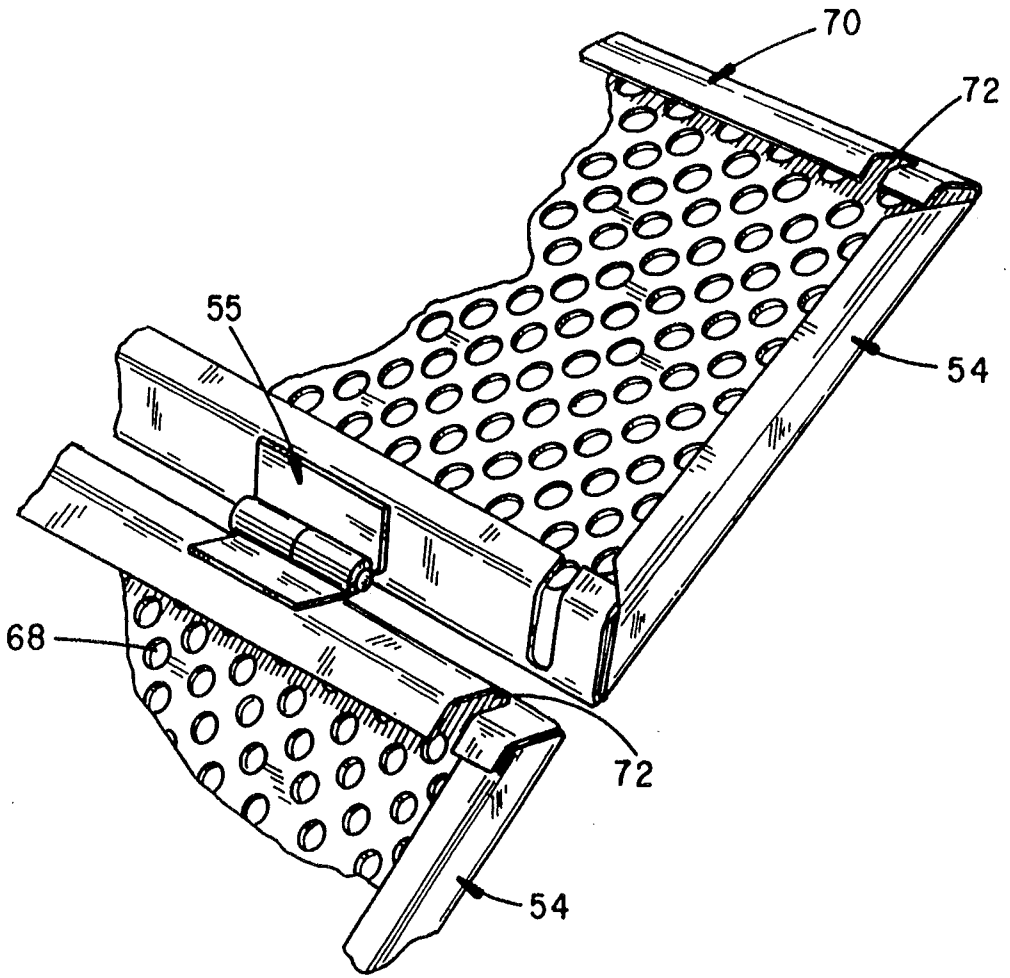
FIG. 4 is a perspective drawing of a detailed section of the undersurface of mating support track sections.

With additional attention to FIG. 4, the peripheral edges of each track section 54 are bent to provide a solid peripheral border 70. The border 70 extends about each track piece 54 and 60 to strengthen and add rigidity to each track piece.

Slots 72 are cut into mitered corners of the border 70. The slots 72 mate with bent vertical edges or rails 74 at the sidewall panels 42, 44, 46 and 48 to laterally restrain the support track 36 to the sidewall panels. Proper longitudinal or depth alignment of the support track 36 is assured via the flange 30 and the vertical risers 53 of the sidewall panels.

In lieu of rails 74 and mating slots 72, interconnecting latches might be provided to secure the track sections 54 and 60 to the sidewall panels. For example, pin and sleeve couplers might be provided at selected sections. Preferably, any restraint should be simple and not appreciably add to the cost and complexity of the rack assembly 2.

Returning attention to FIG. 1 and also referring to 7, a perspective drawing is shown of an end stop 80. The end stop 80 is constructed to a fixed length corresponding to the width of the support track sections 54 and 60. The stop 80 is formed as an extrusion or a formed piece. Fastener tabs 82 are formed along a bottom edge and mate with the track apertures 68. Upon compressing the sidewalls of the stop 80 toward one another, inserting the tabs 82 into appropriate apertures 68 and releasing the sidewalls, the stop 80 is secured to the track support 36.

Figure 8:
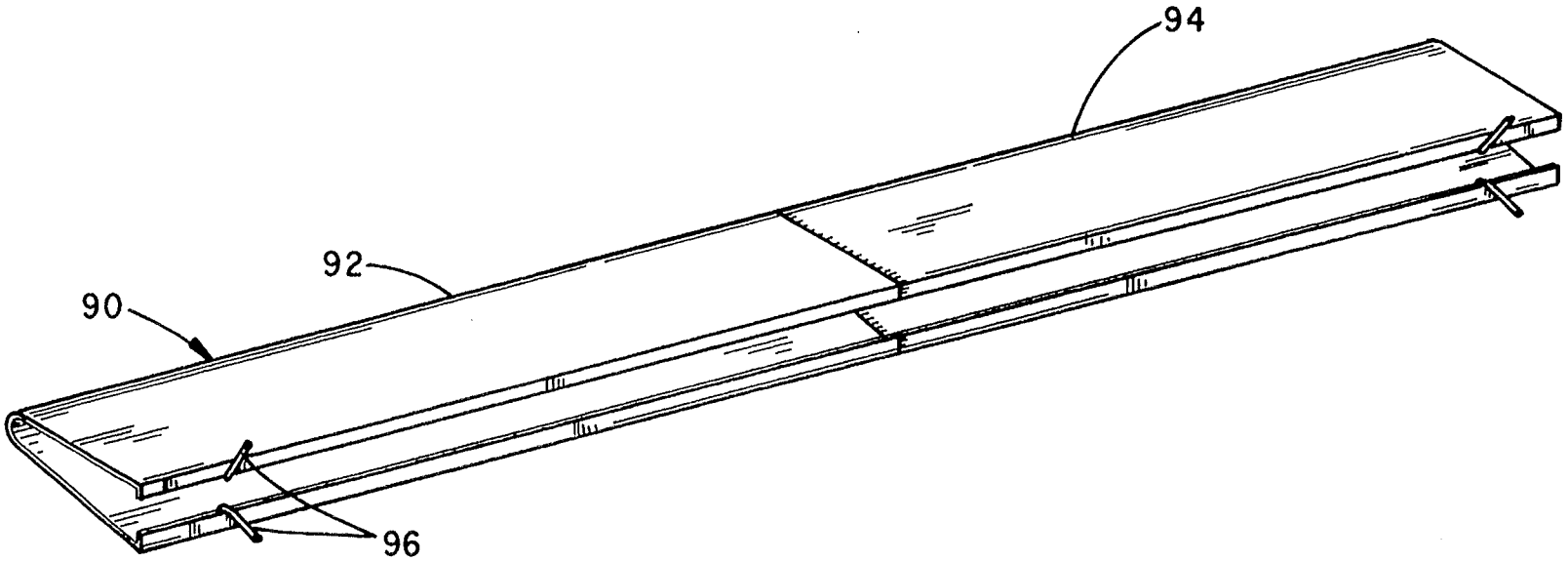
FIG. 8 is a perspective drawing of a longitudinal separator, which mounts to the product support track.

FIG. 8 depicts a length adjustable longitudinal divider 90. The divider 90 is constructed of two interlocking pieces 92 and 94 which slip mount to one another. Pins 96 project along lower edges of the divider 90 and mate with the track apertures 68 in a fashion similar to the stop 80 to fix the lateral sides or longitudinal divisions of a rack arrangement. One or more end stops 80 or dividers 90 are typically added to the track support assembly 36. The lengths of the end stops 80 and dividers 90 can also be varied as necessary.

As apparent from the above, the modular construction and hinged track of the present rack 2 provides numerous advantages to the user. The rack 2 is particularly cost effective via the flexibility of being able to arrange the rack 2 into any number of display configurations. Accordingly, even though the invention has been described with respect to presently preferred constructions and considered modifications thereto, still other construction may be suggested to those skilled in the art. The following claims should therefore be interpreted to include all equivalent embodiments within the spirit and scope thereof.

What is claimed is:

1. Product display apparatus comprising:

a) a base including a plurality of couplers;

b) a plurality of sidewall panels, wherein said sidewall panels include a plurality of rails and a plurality of fasteners, which fasteners interlock with said couplers;

c) a product support track, wherein said support track includes a plurality of track sections, wherein each of said track sections includes a plurality of hinge pins and a plurality of bored sleeves secured to peripheral edges of each track section, wherein said pins interlock with the bores of said sleeves to pivotally secure said track sections to one another, such that the length of the support track can be varied upon removing or adding track sections, and wherein each of said track sections includes a plurality of slots at a bottom surface, which slots interlock with said rails.

2. Apparatus as set forth in claim 1 wherein said track sections are perforated and further including a plurality of dividers secured to said preforations for segmenting the surface of said support track into a plurality of regions.

3. Product display apparatus comprising:

a) a base including a plurality of couplers;

b) a plurality of sidewall panels, wherein said sidewall panels include a plurality of fasteners which interlock with said couplers;

c) a product support track, wherein said support track includes a plurality of track sections, wherein at least a first track section includes a plurality of hinge pins at a peripheral edge and at least a second track section includes a plurality of bored sleeves at a peripheral edge, wherein said hinge pins laterally interlock with said sleeves to pivotally secure said first and second track sections to one another and whereby the length of the support track can be varied upon removing or adding track sections; and e) means for retaining said support track to said sidewall panels.

4. Apparatus as set forth in claim 3 wherein each of said track sections includes a plurality of slots formed at a bottom surface of said track and wherein said slots interlock with said sidewall panels.

5. Apparatus as set forth in claim 4 wherein said base includes a plurality of couplers and wherein said sidewall panels include a plurality of projections which projections interlock with said couplers.

6. Apparatus as set forth in claim 3 wherein said base includes a plurality of pieces which define sides and ends and wherein each of said sides comprise first and second channels which channels interlock with one another to permit a length adjustment of said base along an axis.

7. Apparatus as set forth in claim 3 wherein at least one of said plurality of sidewall panels comprises a plurality of planar pieces which pieces telescope from one another.

8. Apparatus as set forth in claim 7 wherein said base includes a plurality of couplers, which couplers, which couplers each includes a bore, and wherein said sidewall panels includes projections which interlock to said couplers.

9. Apparatus as set forth in claim 7 wherein ones of said panels includes peripheral edges which exhibit a vertical riser surface having an acute angular relation to the base.

10. Apparatus as set forth in claim 3 wherein said track sections are perforated and further including a plurality of dividers having a plurality of projections, and wherein said projections mount to said perforations to segment the support surface of said support of said support track into a plurality of regions.

11. Apparatus as set forth in claim 3 wherein at least one of said plurality of track sections comprises a plurality of planar pieces which pieces telescope from one another.

12. Product display apparatus comprising:

a) abase comprised of a plurality of members forming a first pair of opposed sides and a second pair of opposed sides, at least one pair of said first and second pair of opposed sides comprising interlocking members to permit a length adjustment of said base along an axis, said pair of opposed sides having said interlocking members including a plurality of couplers;

b) a plurality of sidewall panels having a plurality of fasteners which interlock with selected ones of said couplers; and c) a product support track supported from said base and said sidewall panels comprised of a plurality of sections, wherein a product support surface of each track section includes a plurality of perforations, wherein each track section includes a plurality of hinge pins and a plurality of sleeves having a bore secured to peripheral edges of each track section, wherein the pins and sleeves of adjacent track sections interlock with one another to hingedly secure said track sections together, and wherein each track section includes a plurality of slots at a bottom surface, which slots interlock with said sidewall panels.

13. Apparatus as set forth in claim 11 including a plurality of dividers having a plurality of projections, and wherein said projections mount to said perforations to segment the support surface of said support track into a plurality of regions.

14. Product display apparatus comprising:

a) a base wherein said base includes a plurality of pieces which define opposite sides and ends and wherein at least one of said opposite sides and ends comprise first and second sections which sections interlock with one another to permit a length adjustment of said base along one axis;

b) a plurality of planar sidewall panels, which panels include means for securing the panels to one another to fit the base along said axis;

c) means for securing said sidewall panels to said base;

d) a product support track secured to said sidewall panels, wherein said support track includes a plurality of track sections, and wherein each track section includes means for detachably, hinging each track section to an adjacent track section such that the length of the support track can be varied upon removing or adding track sections; and e) means for retaining said support track to said sidewall panels.

15. Apparatus as set forth in claim 13 wherein said means for detachably hinging each track section to an adjacent track section includes a plurality of hinge pins secured to one peripheral edge and a plurality of sleeves having a bore secured to an opposite peripheral edge, wherein said pins interlock with the bores of said sleeves to pivotally secured said track sections together.

16. Apparatus as set forth in claim 15 wherein said base and sidewall panels define a plurality of vertically displaced product display surfaces and including a plurality of dividers secured to said support track for segmenting a display surface of said support track into a plurality of regions.

17. Apparatus as set forth in claim 16 wherein said dividers each includes a plurality of tabs, which tabs mate to perforations at said track section.

18. Apparatus as set forth in claim 7 wherein each of said dividers comprise first and second channels which channels interlock with one another, whereby the length of the divider may be adjusted.

19. Apparatus as set forth in claim 15 wherein at least one of said plurality of track sections comprises a plurality of planar pieces which pieces telescope from one another, whereby the sidewall panels may be adjusted to fit the base.

* * * * *